US006975831B2

(12) United States Patent
Kumadaki et al.

(10) Patent No.: US 6,975,831 B2
(45) Date of Patent: Dec. 13, 2005

(54) IMAGE FORMING APPARATUS

(75) Inventors: Kazuhiro Kumadaki, Fukuoka (JP); Masayoshi Kondou, Ogoori (JP); Tadashi Hayamizu, Chikushino (JP); Shinichi Tanaka, Kurume (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/659,120

(22) Filed: Sep. 10, 2003

(65) Prior Publication Data

US 2004/0052562 A1 Mar. 18, 2004

(30) Foreign Application Priority Data

Sep. 12, 2002 (JP) ..... P. 2002-266718
Sep. 12, 2002 (JP) ..... p. 2002-266721

(51) Int. Cl.[7] ..... G03G 15/00
(52) U.S. Cl. ..... 399/393; 400/624; 271/171
(58) Field of Search ..... 399/393; 400/624, 400/625, 642, 691, 692, 693; 271/3.14, 4.01, 271/9.11, 164, 171

(56) References Cited

U.S. PATENT DOCUMENTS 4,579,328 A 4/1986 Hagihara et al.
5,695,182 A 12/1997 Sekine
5,746,528 A * 5/1998 Mayer et al. ..... 400/625
6,055,410 A 4/2000 Marumoto et al.
6,419,410 B1 * 7/2002 Osmus et al. ..... 400/624
6,474,884 B2 * 11/2002 Chiu ..... 400/624
6,666,601 B1 * 12/2003 Bingham et al. ..... 400/624

FOREIGN PATENT DOCUMENTS

| | | |
|---|---|---|
| DE | 29 17 307 | 10/1980 |
| DE | 36 08 273 A1 | 9/1987 |
| EP | 0 398 260 A2 | 11/1990 |
| JP | 06-127711 | 5/1994 |
| JP | 09-146325 | 6/1997 |
| JP | 10-268585 | 10/1998 |
| JP | 2000-072325 | 3/2000 |
| JP | 2001-166665 | 6/2001 |

* cited by examiner

*Primary Examiner*—Ren Yan
(74) *Attorney, Agent, or Firm*—Pearne & Gordon LLP

(57) ABSTRACT

An image forming apparatus includes a media feed cassette 100 that is detachably attached to the image forming apparatus and contains medias used for printing therein. The media feed cassette 100 includes a chassis 100*a*; a cassette-side media stacking portion 101 which is mounted to said chassis 100*a* and contains medias therein, and is located within said image forming apparatus when it is attached to said image forming apparatus; a tray-side media stacking portion 102 being attached to said chassis 100*a* such that said tray-side media stacking portion is extendable to outside of said image forming apparatus, medias being put in said tray-side media stacking portion when it is extended outside; and a pickup unit 107 for picking up, sheet by sheet, medias put on said tray-side media stacking portion 102.

17 Claims, 11 Drawing Sheets

IMAGE FORMING APPARATUS

BACKGROUND OF THE INVENTION

The present invention relates to a media supply device to be attached to an image forming apparatus, such as a copying machine, a facsimile, and a printer.

In an image forming apparatus, such as a printer, a copying machine, and a facsimile, as disclosed in JP-A-2001-166665, for example, a media feed cassette in which a stack of medias is placed is attached to a main body of the image forming apparatus. To print, those medias are pulled out of the media feed cassette sheet by sheet.

Another image forming apparatus is also known as disclosed in U.S. Pat. No. 6,055,410, for example. In the apparatus, in addition to such a media feed cassette, a media feed tray for manual media feeding is provided and the medias may be placed at another location. The apparatus is able to print on a media whose size is different from that of the media placed in the media feed cassette.

The media feed cassette is separate from the image forming apparatus, and is attached to the apparatus, while the media feed tray is provided integrally with the image forming apparatus. Accordingly, it is difficult to align the media in the media feed cassette with that in the media feed tray. When those medias are mis-aligned with each other, a problem arises that a printing position on the media fed from the media feed cassette is different from that on the media fed from the media feed tray.

The media on the media feed tray is picked up and pulled out of the tray by a pickup unit provided in the main body of the image forming apparatus. Accordingly, it is difficult to secure a satisfactory position accuracy between the media and the pickup unit, and as a result, a separability of the media is poor. Such a problem is also present in the image forming apparatus under discussion.

SUMMARY OF THE INVENTION

Accordingly, an object of the present invention is to provide a media supply device which prevents a misalignment between medias placed at different locations.

Another object of the invention is to provide a media supply device which has a good separability of the media.

According to the invention, an image forming apparatus having a main body for forming an image on a media, a first media tray, detachably mounted to said main body, for containing said medias therein, and a second media tray being formed integrally with said first media tray, detachably mounted to said main body, and able to contain said medias therein, wherein said second media tray is extendible from said first media tray, and said second media tray is able to switch between a first state that said second media tray is housed in said main body and a second state that said second media tray is extended to outside of said main body.

DETAILED DESCRIPTION OF THE PREFERRED EMBODIMENTS

Figure 1:
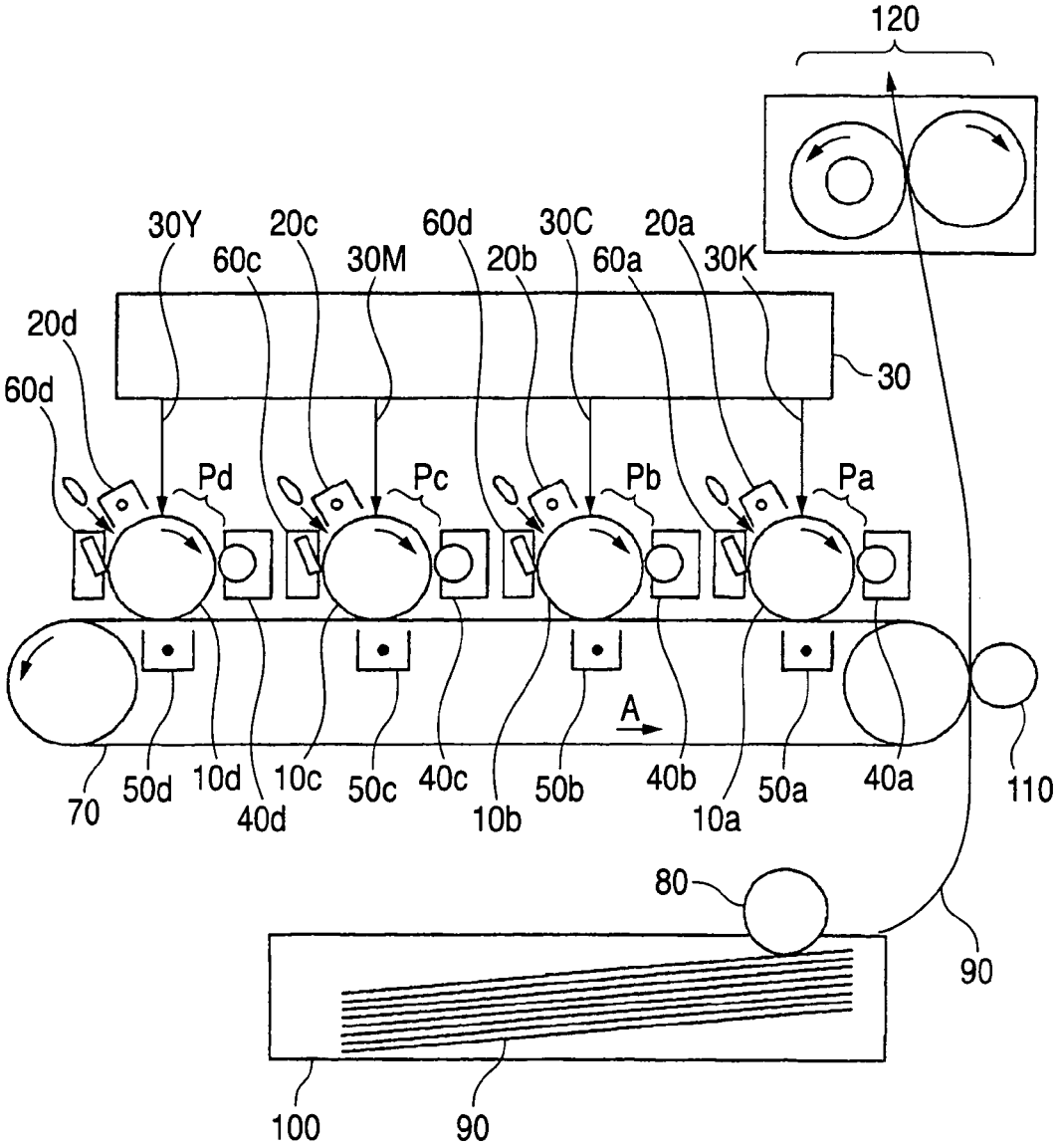
FIG. 1 is an explanatory diagram showing an overall construction of an image forming apparatus according to an embodiment of the present invention.

The preferred embodiment of the present invention will be described with reference to the accompanying drawings. Throughout the drawings, like or equivalent portions are designated by like reference numerals, for simplicity.

Figure 2:
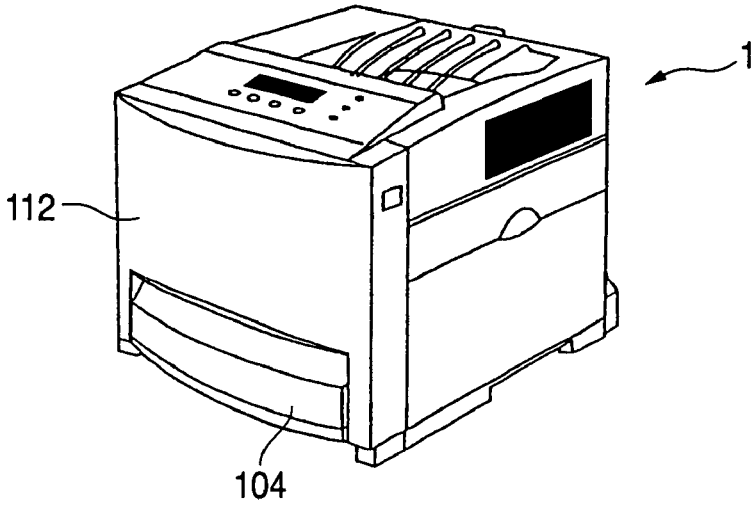
FIG. 2 is a perspective view showing the image forming apparatus of FIG. 1.
Figure 3:
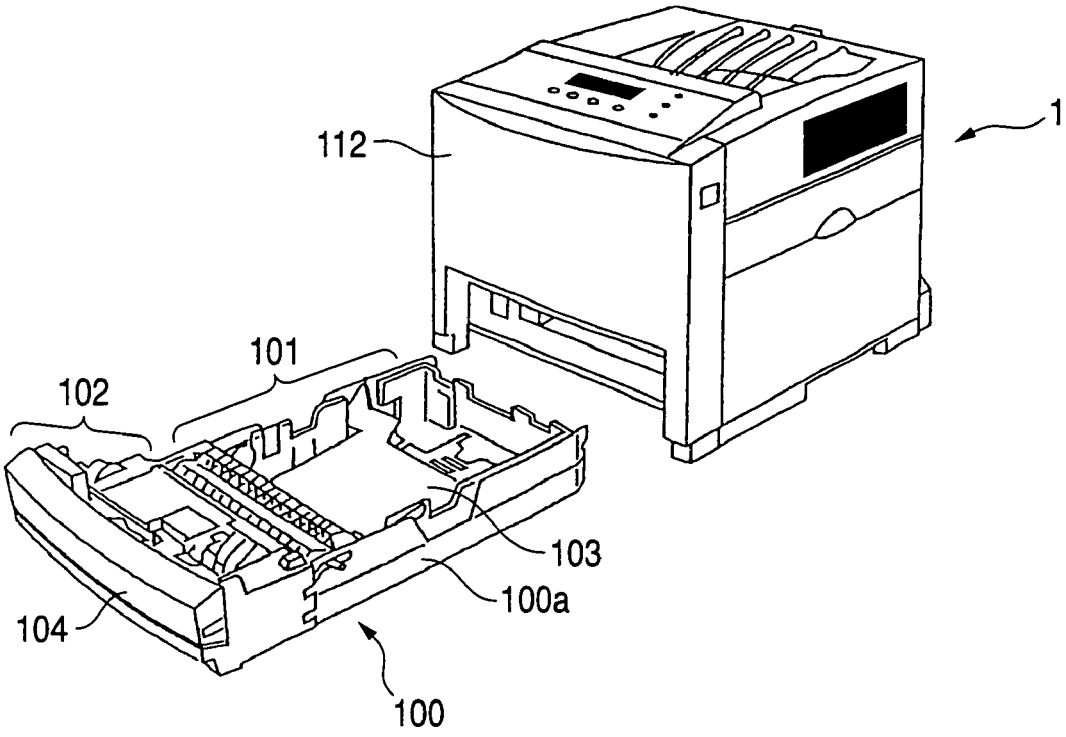
FIG. 3 is a perspective view showing the image forming apparatus from which a media supply device is detached.
Figure 4:
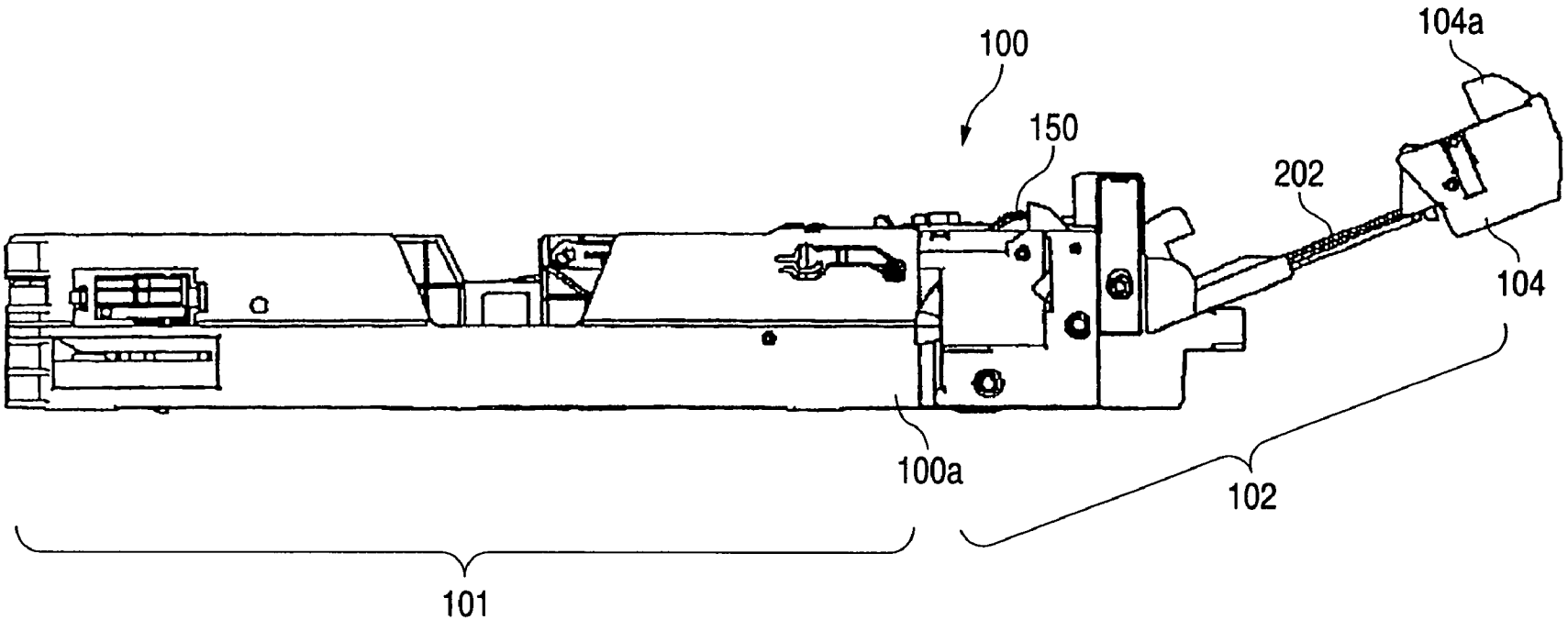
FIG. 4 is a side view showing the media supply device of which a tray-side media stacking portion is extended outside.
Figure 5:
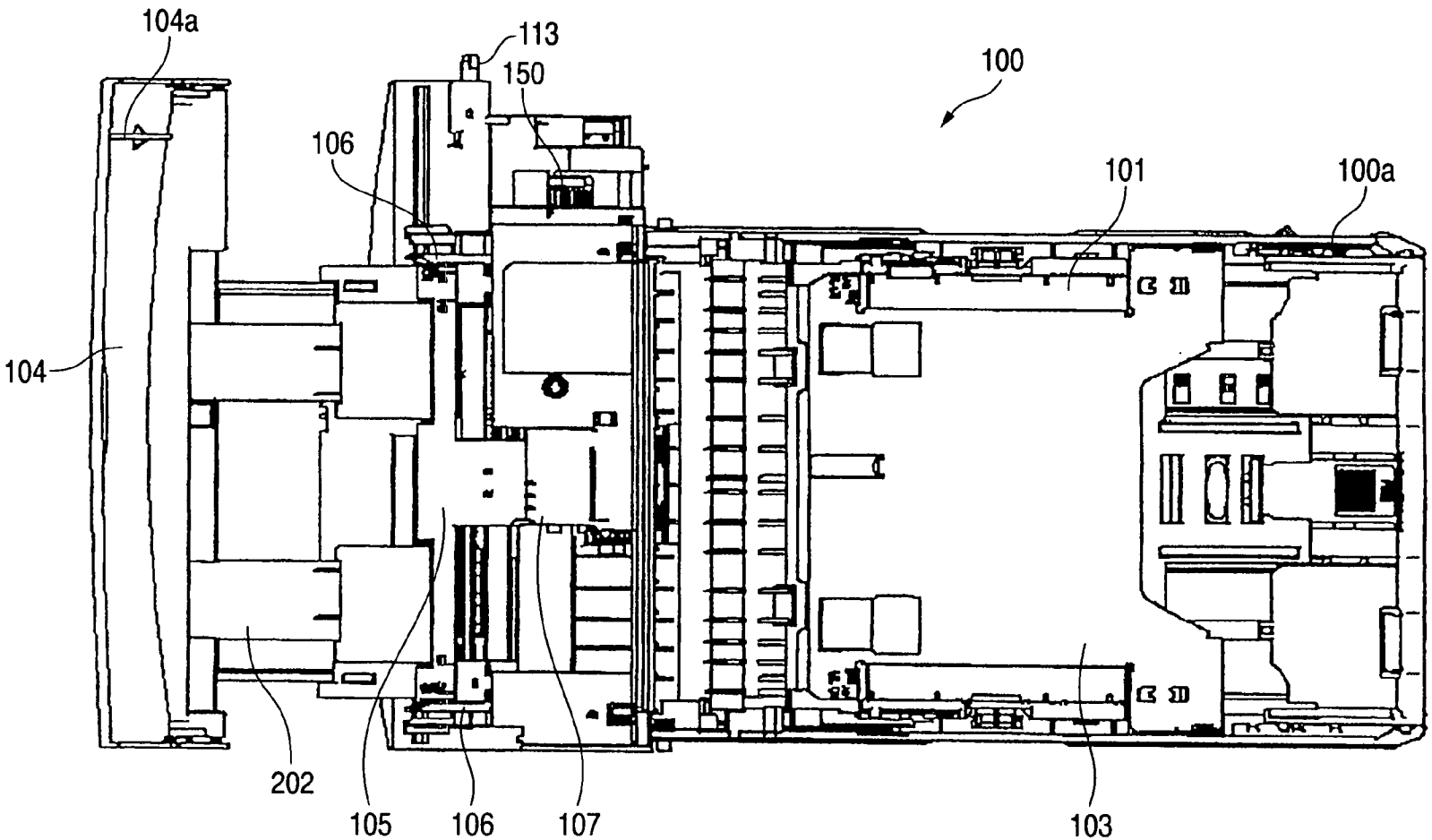
FIG. 5 is a plan view showing the media supply device of FIG. 4.
Figure 6:
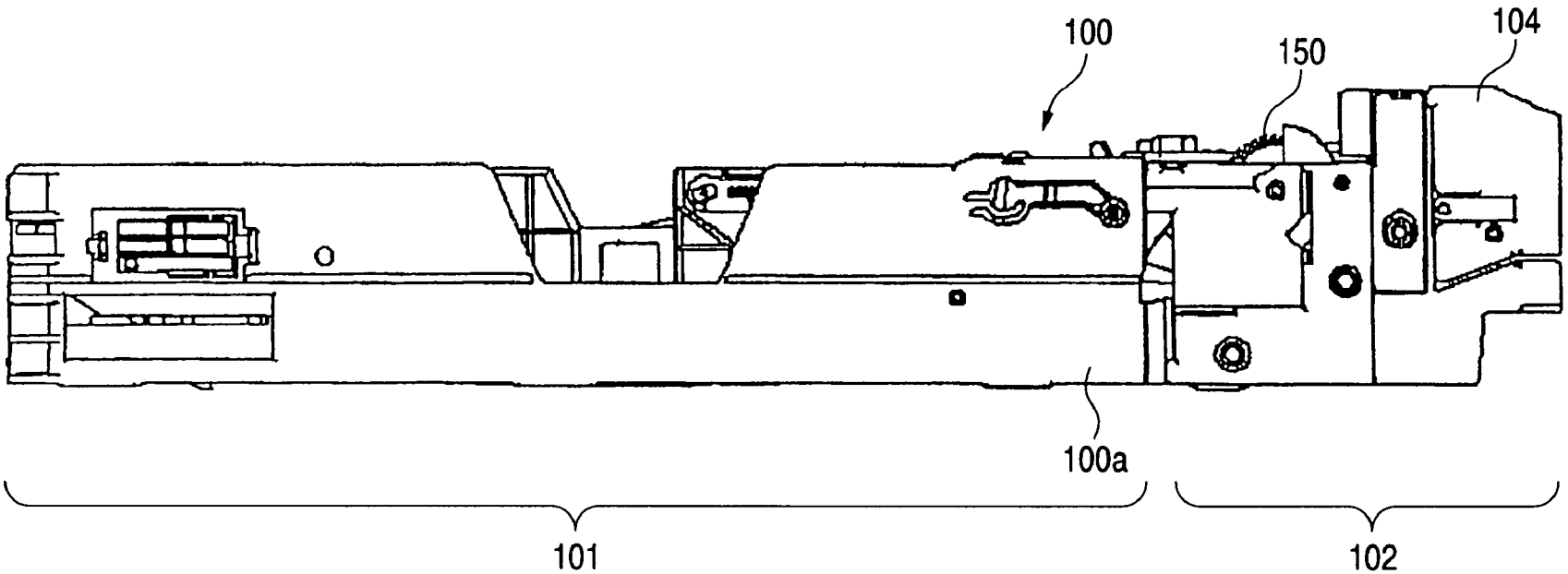
FIG. 6 is a side view showing the media supply device of which the tray-side media stacking portion is housed in the media supply device.

FIG. 1 is a view showing a construction of an image forming apparatus provided with a media supply device which is an embodiment of the present invention. FIG. 2 is a plan view showing the media supply device for use with the image forming apparatus of FIG. 1 in a state that a tray-side media stacking portion of the media supply device is located in the apparatus. FIG. 3 is a side view showing the media supply device for use with the image forming apparatus of FIG. 1 in a state that the tray-side media stacking portion of the media supply device is located in the apparatus. FIG. 4 is a plan view showing the media supply device for use with the image forming apparatus of FIG. 1 in a state that the tray-side media stacking portion of the media supply device is extended outside. FIG. 5 is a side view showing the media supply device for use with the image forming apparatus of FIG. 1 in a state that the tray-side media stacking portion of the media supply device is extended outside. FIG. 6 is a side view showing a structure of the tray-side media stacking portion of the media supply device.

An outline of the image forming apparatus constructed according to the present invention will first be described. In the description to follow, the image forming apparatus is an image forming apparatus employing the electrophotographic system, in particular a tandem type of image forming apparatus which includes developing devices provided respectively for four basic color toners contributing to the color development of the color image, and in which four color images are superimposed one on another on a transfer body and collectively transferred onto a media material. It is evident that the present invention may be applied not only to the tandem type of image forming apparatus, but also to every type of image forming apparatus irrespective of the number of developing devices and presence of intermediate transfer body.

As seen from FIG. 1, charging devices 20*a*, 20*b*, 20*c* and 20*d*, an exposure unit 3, developing devices 40*a*, 40*b*, 40*c* and 40*d*, transfer devices 50*a*, 50*b*, 50*c* and 50*d*, cleaning devices 60*a*, 60*b*, 60*c* and 60*d* are disposed around photo-receptor drums 10*a*, 10*b*, 10*c* and 10*d*, respectively. The charging devices 20*a*, 20*b*, 20*c* and 20*d* uniformly charge the surfaces of the photo-receptor drums 10*a*, 10*b*, 10*c* and 10*d*, respectively. The exposure unit 3 irradiates the surfaces of the charged photo-receptor drums 10*a*, 10*b*, 10*c* and 10*d* respectively with scanning lines 30K, 30C, 30M and 30Y of laser beams corresponding to image data of specific colors, whereby electrostatic latent images are formed on the surfaces of the photo-receptor drums. The developing devices 40*a*, 40*b*, 40*c* and 40*d* develop the electrostatic latent images formed on the photo-receptor drums 10*a*, 10*b*, 10*c* and 10*d* into toner images. The transfer devices 50*a*, 50*b*, 50*c* and 50*d* transfer the toner images that were developed on the photo-receptor drums 10*a*, 10*b*, 10*c* and 10*d*, onto an endless, intermediate transfer belt (intermediate transfer body) 80. The cleaning devices 60*a*, 60*b*, 60*c* and 60*d* remove toner left on the photo-receptor drums 10*a*, 10*b*, 10*c* and 10*d* after the toner images are transferred from the photo-receptor drums 10*a*, 10*b*, 10*c* and 10*d* onto the intermediate transfer belt 70.

The exposure unit 30 is disposed while being slanted with respect to the photo-receptor drums 10*a*, 10*b*, 10*c* and 10*d* at a predetermined angle. The intermediate transfer belt 70 is rotated in a direction of an arrow A in the illustrated case. Image forming stations Pa, Pb, Pc and Pd form color images of black, cyan, magenta and yellow, respectively. The mono-color images of the respective colors having been formed on the photo-receptor drums 10*a*, 10*b*, 10*c* and 10*d* are superimposed one on another on the intermediate transfer belt 70 to thereby form a full color image.

As shown FIGS. 2 and 3, a media feed cassette 100 containing medias 90 therein is detachably provided in a lower part of the main body 1 of the image forming apparatus. The medias 90 are transferred, sheet by sheet, from the media feed cassette 100 into a media transport path by a media feed roller 80.

A media transport roller 110 and a fixing device 120 are disposed along the media transport path. The media transport roller 110 contacts with the outer peripheral surface of the intermediate transfer belt 70 over a predetermined range of the surface, and transfers the color image that was formed on the intermediate transfer belt 70 onto the medias 90. The fixing device 120 fixes the color image, which has been transferred to the medias 90, onto the medias 90 under pressure and heat, which are caused by the nipping and rotation of the roller.

The thus constructed image forming apparatus first forms a latent toner image of a black component of the image information on the photo-receptor drum 10*a*, by cooperation of the charging device 20*a* in the image forming station Pa and the exposure unit 30. The latent image thus formed is visualized into a black toner image by use of the developing unit 40*a* containing black toner, and is transferred onto the intermediate transfer belt 70 by use of the transfer device 50*a*.

While the black toner image is transferred onto the intermediate transfer belt 70, a latent image of the cyan component is formed in the image forming station Pb, and subsequently a cyan toner image of the cyan toner is visualized by use of the developing unit 40*b*. Then, the transfer device 50*b* of the image forming station Pb transfers the cyan toner image, in a superimposing manner, onto the black toner image on the intermediate transfer belt 7, which has undergone the transfer of the black toner image in the preceding image forming station Pa.

Subsequently, a magenta toner image and a yellow toner image will be formed in similar manners. When the super imposing operation of the four color toner images on the intermediate transfer belt 70 is completed, the four color toner images are collectively transferred, by the media transport roller 110, onto the media 90 which has been fed from the media feed cassette 100 by the media feed roller 80. And, the toner image thus transferred is fused and fixed on the medias 90 by the fixing device 120, whereby a full color image is formed on the media 90.

The media feed cassette 100 for use with the image forming apparatus will be described in detail.

As shown in FIGS. 2 to 7, the media feed cassette 100 includes a chassis 100*a*, a cassette-side media stacking portion 101 which is mounted to the chassis 100*a* and contains medias 90 in a stacked fashion, and a tray-side media stacking portion 102.

The cassette-side media stacking portion 101 is located within the image forming apparatus, while being attached to the main body 1 of the image forming apparatus. A stack plate 103 is mounted to the cassette-side media stacking portion 101. The plate 103 moves upward stacked medias 90 with the aid of spring force.

Figure 7:
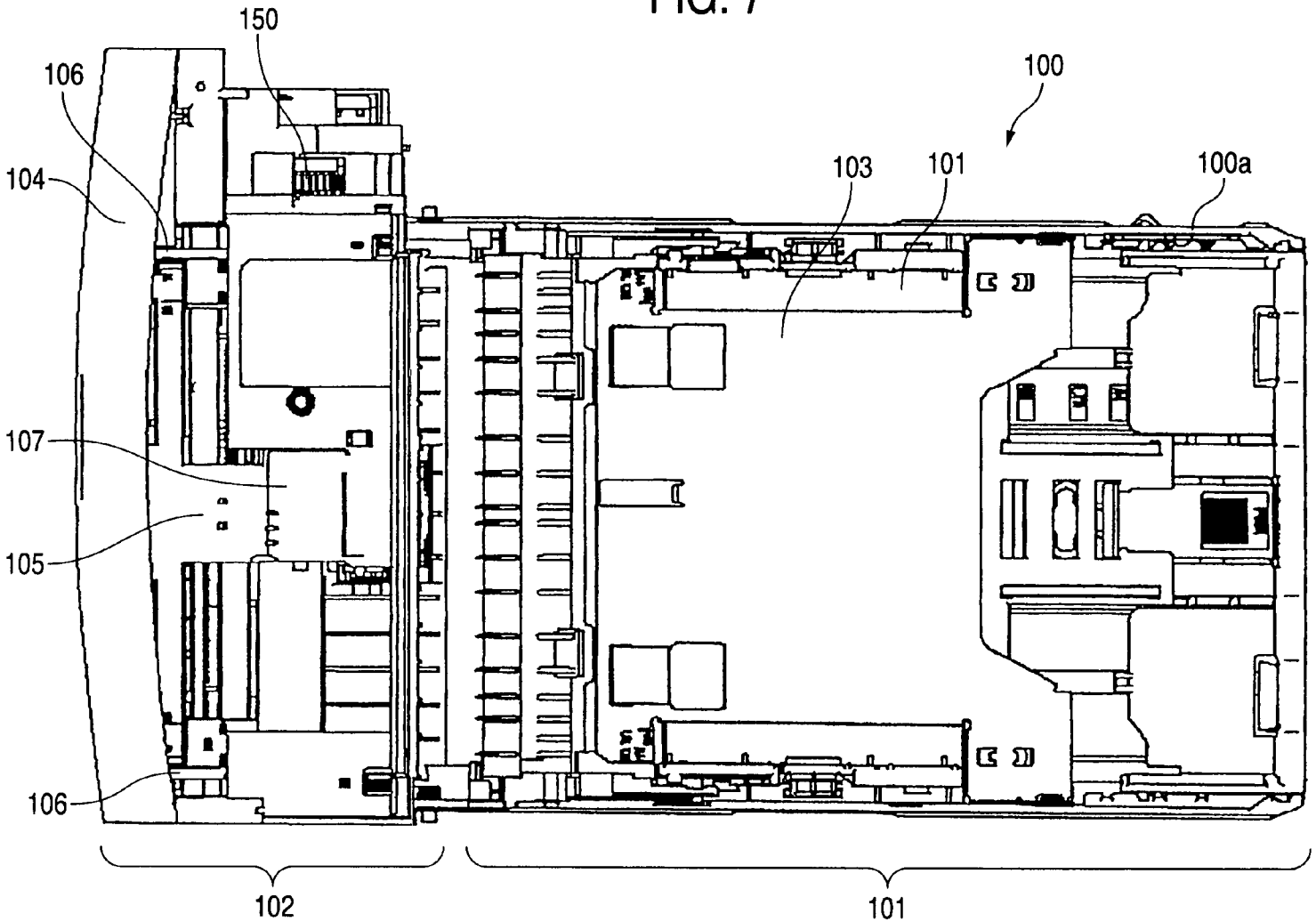
FIG. 7 is a plan view showing the media supply device of FIG. 6.
Figure 8:
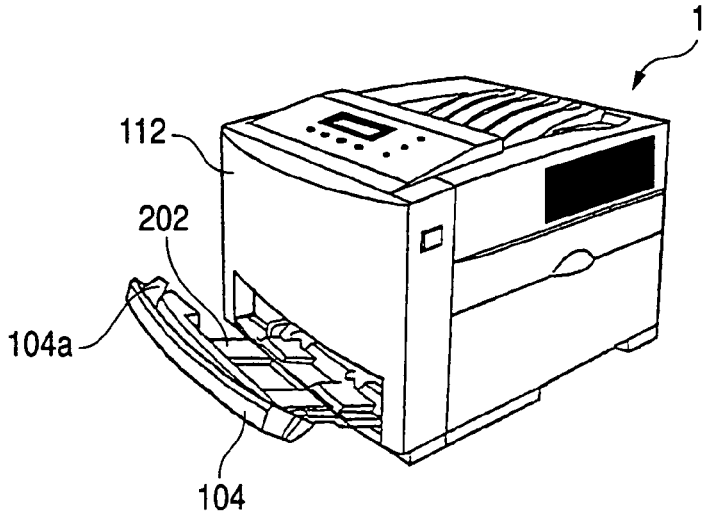
FIG. 8 is a perspective view showing the image forming apparatus of which the tray-side media stacking portion is extended outside.

As shown in FIGS. 4, 5 and 8, the tray-side media stacking portion 102 is attached to the chassis 100*a* such that it is extendable to outside of the image forming apparatus. Medias are stacked in the tray-side media stacking portion 102 being extended outside. A tray cover 104 is provided on the front surface of the tray-side media stacking portion 102. When the tray cover is open, the tray-side media stacking portion 102 is permitted to be pulled out. When it is closed, the tray-side media stacking portion is prohibited from being pulled out. The tray cover 104 being closed (FIGS. 2, 6 7) is opened (FIG. 9), and the tray cover 104 is pulled out, and in this state, medias are stacked on a tray 202 and a stack plate 105 (FIGS. 4, 5, 8).

Figure 9:
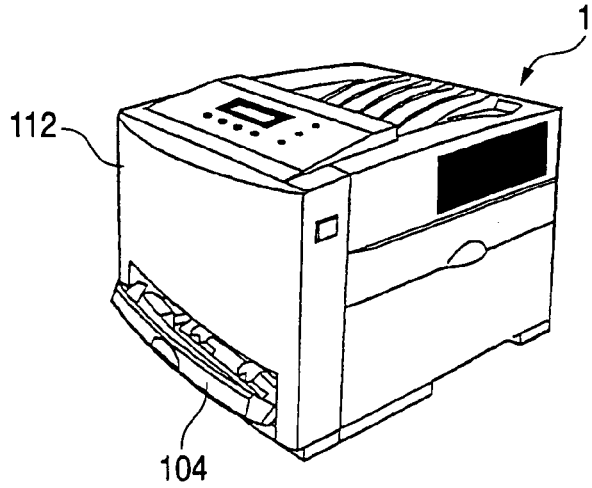
FIG. 9 is a perspective view showing the image forming apparatus of which a tray cover is opened.
Figure 10:
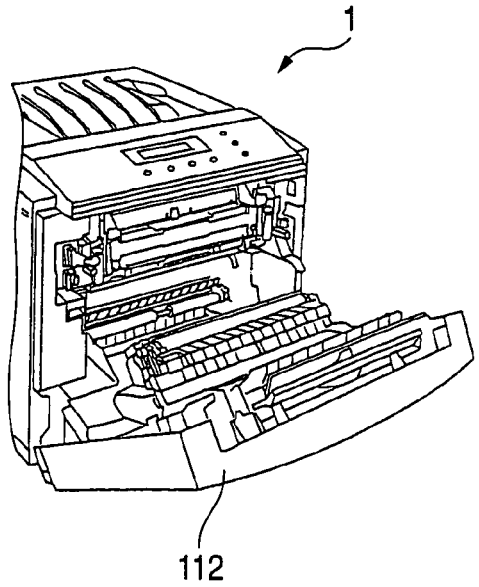
FIG. 10 is a partially, perspective view showing the image forming apparatus of which a jam removal door is opened.

As shown in FIGS. 2, 3, 8, 9 and 10, in the main body 1 of the image forming apparatus having the media feed cassette 100 attached thereto, a jam removal door 112 is located just above the media feed cassette 100. When the media supplied from the media feed cassette 100 jams up, the jam removal door 112 is used for removing the media jam on the media transport path. To remove the media jammed in the main body 1 of the image forming apparatus, the jam removal door 112 is pulled to this side to be opened as shown in FIG. 10, and in this state the jammed media is removed.

Figure 11:
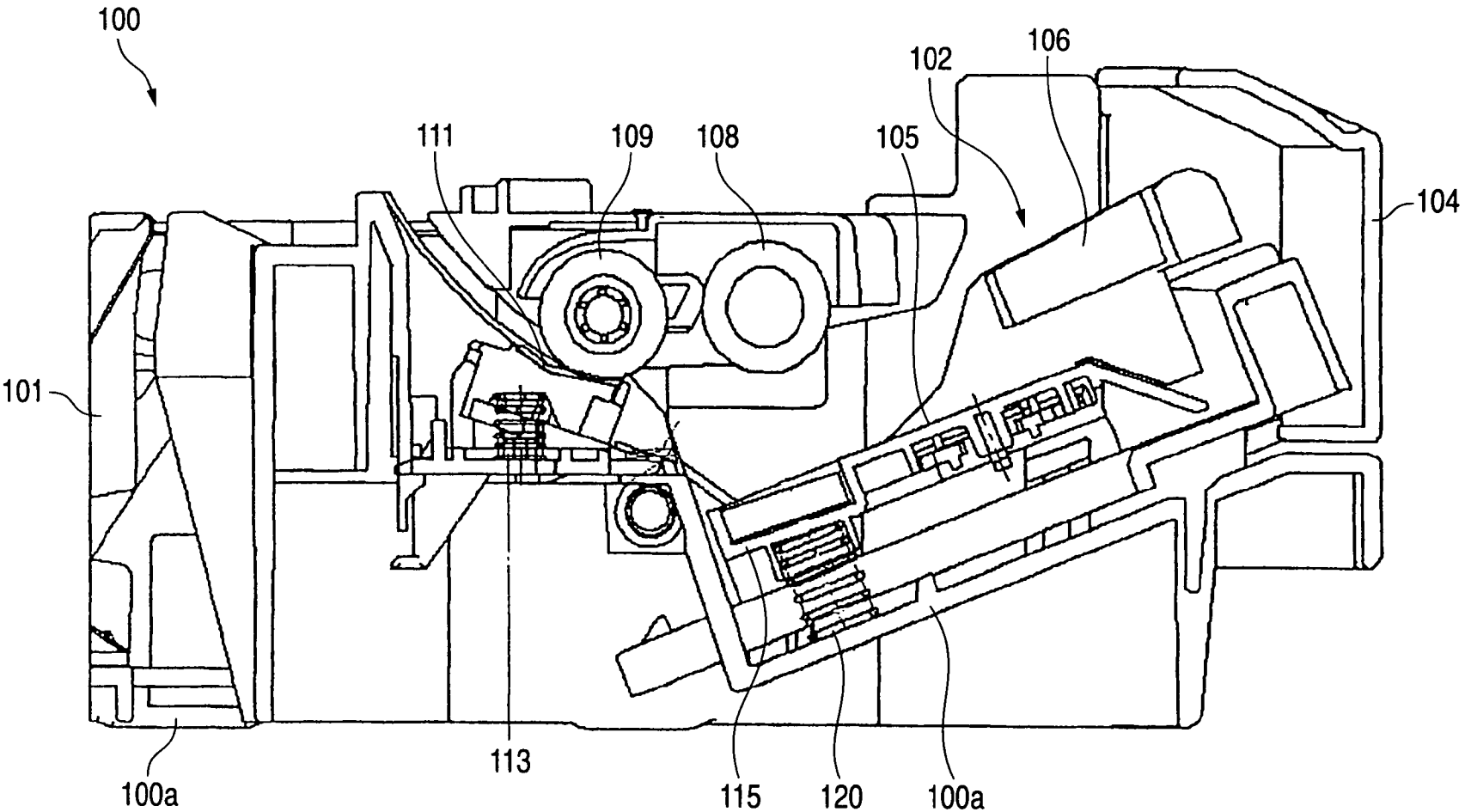
FIG. 11 is a partially perspective view showing a key portion of the media supply device in the image forming apparatus.

As illustrated in detail in FIG. 11, the tray-side media stacking portion 102 includes a stack plate 105 on which medias are stacked, and a guide plate 106 for defining the width of the medias stacked on the stack plate 105. The guide plate 106 is slidable and able to adaptively define various sizes of the medias.

Figure 12:
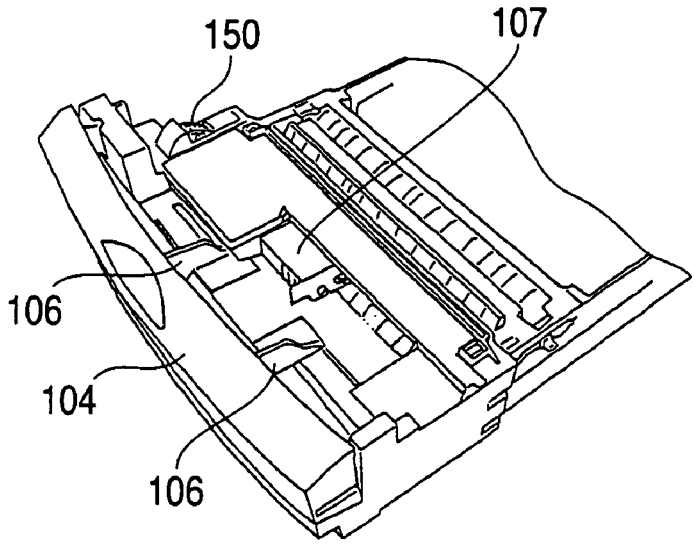
FIG. 12 is a partially perspective view showing a pickup unit attached to the image forming apparatus.
Figure 13:
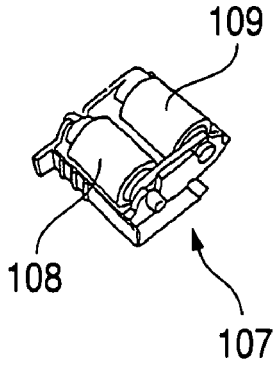
FIG. 13 is a perspective view showing a rear side of the pickup unit of FIG. 12.

A pickup unit 107 is located between the cassette-side media stacking portion 101 and the tray cover 104. The pickup unit 107 picks up, sheet by sheet, medias stacked on the tray 202 and the stack plate 105. More specifically, the pickup unit 107 includes a media feed roller 108 for picking up one uppermost media or several medias of the medias stacked on the stack plate 105 and the tray 202 of the tray-side media stacking portion 102, and a separation roller 109 for reliably separating the media picked up by the media feed roller 108 from the stacked medias or one media from the several medias picked up, by the utilization of a friction between the media and the roller. The separation roller 109 and a retard pad 111 cooperate to operate for the media separation. The pickup unit 107 shown in FIG. 13 may be attached to and detached from a shaft (not shown) coupled to a gear 150 shown in FIG. 12. When the pickup unit 107 is attached to the tray-side media stacking portion 102, it is driven by a shaft (not shown) coupled to the gear 150. The gear 150 receives a driving force from a drive mechanism (not shown) which is provided in the main body 1 of the image forming apparatus.

A spring 120 for pressing the media feed roller 108 against the stacked medias is provided between the rear surface of the stack plate 105 and the chassis 100*a*. A spring 113 for pressing the retard pad 111 against the separation roller 109 is provided on the rear side of the retard pad 111.

In the media feed cassette 100 thus constructed, the cassette-side media stacking portion 101 and the tray-side media stacking portion 102 are mounted on the same chassis 100*a*. This unique feature prevents a misalignment of the medias placed at one location (cassette-side media stacking portion 101) with those at another location (tray-side media stacking portion 102), which is different from the former.

The pickup unit 107 for picking up the medias on the tray-side media stacking portion 102 is provided on the media feed cassette 100. With this feature, a position accuracy between the media and the pickup unit 107 is improved, so that a media separability is good.

The pickup unit 107 is provided in the media feed cassette 100. Therefore, the pickup unit 107 can easily be taken out when the media feed cassette 100 is detached from the main body 1. This feature provides an easy exchanging work of the pickup unit 107.

When the media supplied from the cassette-side media stacking portion 101 or the tray-side media stacking portion 102 jams up, the user detaches the media feed cassette 100 from the main body of the image forming apparatus, puts his hand into the space of the main body where the media feed cassette 100 was located, and removes the jammed media. Thus, the jam removal work is easy. A locking mechanism of the embodiment will be described. The media feed cassette 100 includes a lock pin 113 which is movable to between a first position at which the lock pin prohibits opening of the jam removal door 112 of the main body 1 of the image forming apparatus, and a second position at which the lock pin permits the jam removal door to open.

Figure 14:
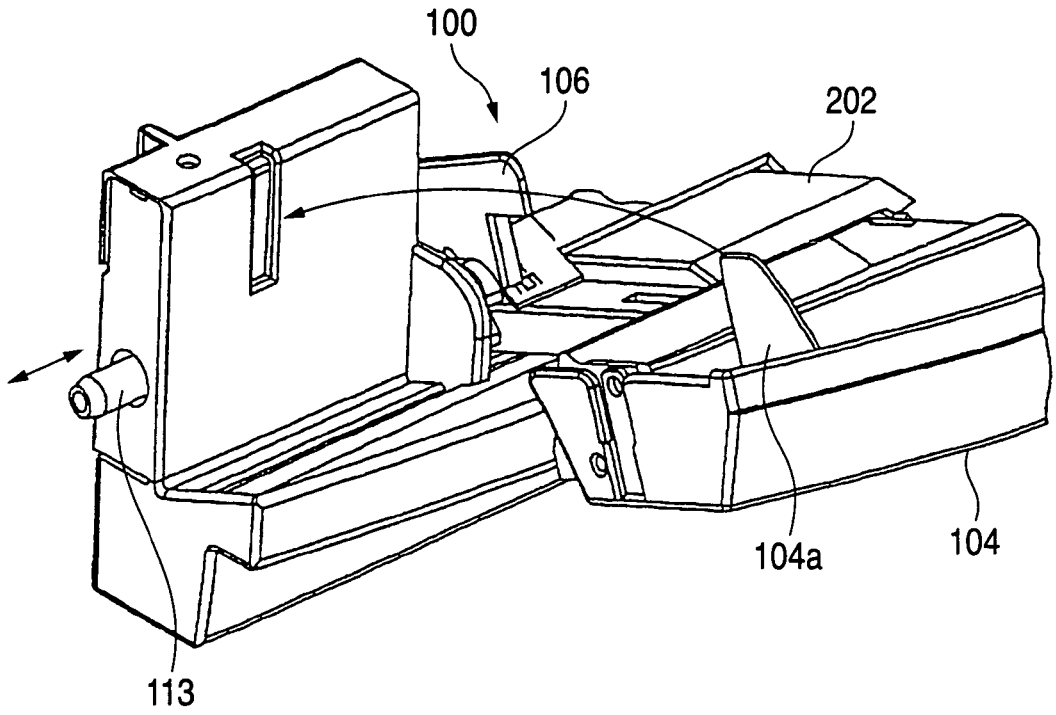
FIG. 14 is a partially perspective view showing the media supply device of which the tray cover is opened.

To be more specific, at the first position shown in FIGS. 5 and 14, the lock pin 113 passes through the jam removal door 112 and is partly inserted into the main body 1 of the image forming apparatus. In this state, it is impossible to open the jam removal door 112, and hence, the user cannot extract the media feed cassette 100 from the main body 1 of the image forming apparatus. At the second position shown in FIGS. 7 and 15, the lock pin 113 is placed in the media feed cassette 100. Accordingly, when the lock pin is at the second position, the jam removal door 112 may be opened, and the media feed cassette 100 maybe extracted from the main body 1 of the image forming apparatus.

Figure 15:
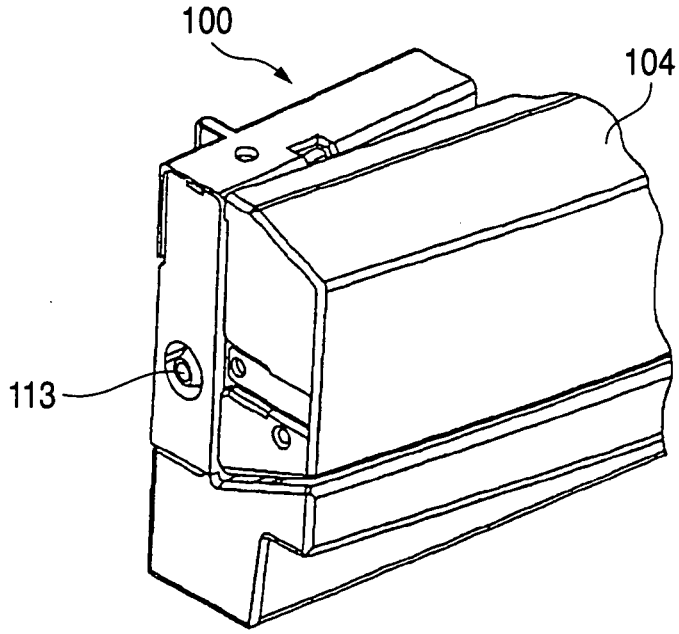
FIG. 15 is a partially perspective view showing the media supply device of which the tray cover shown in FIG. 14 is closed.
Figure 16:
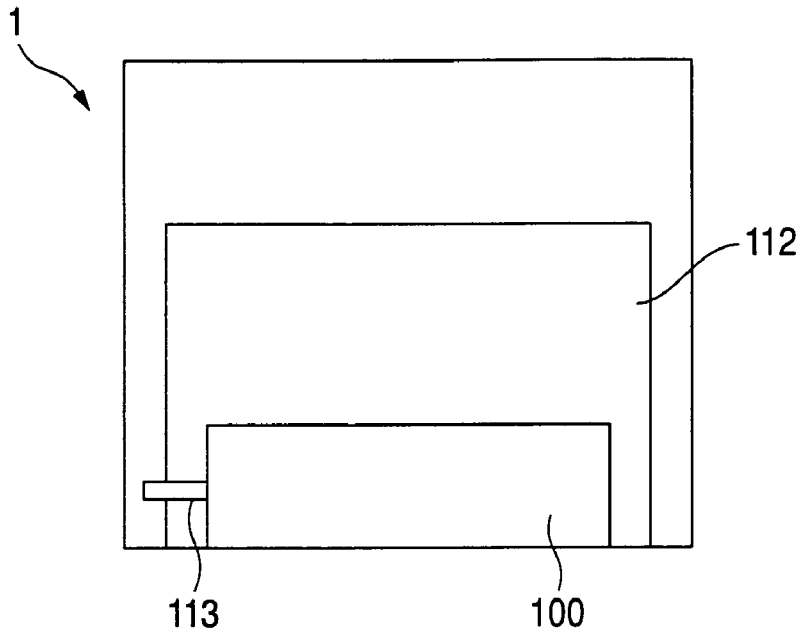
FIG. 16 is a conceptual diagram showing a lock pin prohibiting the opening of the jam removal door in the image forming apparatus.

As shown in FIGS. 14 and 15, the lock pin 113 displaces in link to operation of the tray cover 104. In an open state of the tray cover 104, the lock pin 113 is put at the first position, and in a closed state, it is put at the second position. A state that the lock pin 113 is at the first position and inhibits the jam removal door 112 from opening is conceptually shown in FIG. 16.

Figure 17:
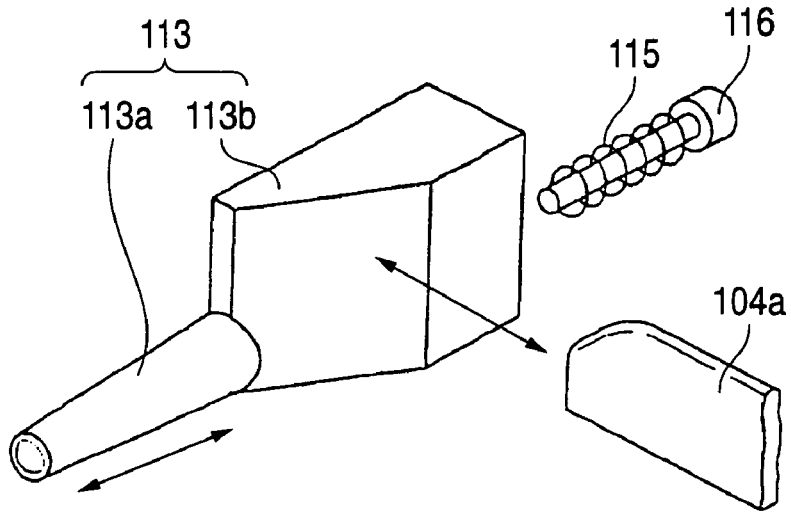
FIG. 17 is a partially perspective view useful in explaining a construction and operation of the lock pin.

As shown in FIG. 17, the lock pin 113 includes a rod part 113*a* and a base part 113*b*. The base part 113*b* is formed integrally with the rod part 113*a* and has a slant surface slanting to a displacing direction of the lock pin.

The lock pin 113 is urged toward the first position by a spring 115 buried in a shaft 116. A rib 104*a* is formed on the tray cover 104. The rib 104*a* abuts on the slant surface of the base part 113*b* to displace the lock pin 113 in a direction opposite to the first position. When the tray cover 104 is set to the opening position, the spring 115 causes the lock pin 113 to displace to the first position. And, the rod part 113*a* passes through the jam removal door 112 and is partly inserted into the main body 1 of the image forming apparatus. As shown in FIGS. 6, 7 and 15, when the tray cover 104 is set to the closing position, the rib 104*a* of the tray cover 104 displaces the lock pin 113 into the media feed cassette 100, while resisting the spring force, and the lock pin displaces to the second position.

In operation of the lock mechanism thus constructed, when the tray-side media stacking portion 102 is extracted and the rib 104*a* is in non-contact with the lock pin 113, or when the tray cover 104 is in an open state as shown in FIGS. 9 and 14, the lock pin 113 displaces to the first position to prohibit the jam removal door 112 from opening. Accordingly, when media jam occurs in a state that the tray-side media stacking portion 102 is extracted, the tray-side media stacking portion 102 is housed and the tray cover 104 is closed, the lock pin 113 is put at the second position, and the jam removal door 112 is opened. As a result, the jam removal door 112 is never opened in a state that the tray-side media stacking portion 102 is extracted. Therefore, there is no chance that the jam removal door 112 is unintentionally opened and it hits the tray-side media stacking portion 102 to damage it.

When the tray-side media stacking portion 102 is not drawn out, the lock pin 113 is put at the second position by the tray cover 104 being in a closed state. Accordingly, if a media jam occurs in this state, the user opens the jam removal door 112 directly and removes the jam.

As described above, in the embodiment, the cassette-side media stacking portion 101 and the tray-side media stacking portion 102 are mounted on the same chassis 100*a*. This unique feature prevents a misalignment between the medias placed at different locations, i.e., cassette-side media stacking portion and tray-side media stacking portion.

The pickup unit 107 for picking up the medias on the tray-side media stacking portion 102 is provided on the media feed cassette 100. With this feature, a position accuracy between the media and the pickup unit 107 is improved, so that a media separability is good.

In the conventional technique, the exchanging work of the expendable pickup unit for picking up medias sheet by sheet by the utilization of friction, is not efficient since the pickup unit is provided in the main body of the image forming apparatus as described above. In this connection, it is noted that the pickup unit 107 is provided in the media feed cassette 100 in the embodiment of the invention. Therefore, the pickup unit 107 can readily be taken out, if the media feed cassette 100 is detached from the main body 1 of the image forming apparatus. Therefore, the user can easily exchange the pickup unit 107 with another pickup unit.

In the conventional image forming apparatus, when a media supplied from the media tray jams up, the jam removal work is troublesome since the media supplying port ranging from the media tray into the image forming apparatus is narrow. In such a case, in the embodiment of the invention, the user detaches the media feed cassette 100 from the main body of the image forming apparatus, puts his hand into the space of the main body where the media feed cassette 100 was located, and removes the jammed media. Thus, the jam removal work is easy.

What is claimed is:

1. An image forming apparatus comprising:

a main body for forming an image on a media;

a first media tray, detachably mounted to said main body, for containing said media therein; and a second media tray being formed integrally with said first media tray, detachably mounted to said main body, and able to contain said media therein, wherein said second media tray is extendible from said first media tray, and said second media tray is switchable between a first state that said second media tray is housed in said main body and a second state that said second media tray is extended to outside of said main body and used for directly setting media from outside of said main body into said image forming apparatus;

wherein said second media tray is a manual insertion tray which is extendible in multiple steps;

further comprising a transport roller which is detachably mounted to said second media tray, and transports said media placed on said second media tray.

2. An image forming apparatus according to claim 1, wherein said main body includes a door being openable, and said first media tray includes a lock pin which prohibits said door from opening when said second media tray extends to outside of said main body, and permits said door to open when said second media tray is housed in said main body.

3. An image forming apparatus according to claim 2, wherein said door is a jam removal door for removing said media jammed in said main body.

4. An image forming apparatus according to claim 1, wherein said main body includes a door being openable, said first media tray includes a movable pin, when said second media tray is extended to outside of said main body, said movable pin engaging with and stopping said door at a position where said door is closed, when said second media tray is housed in said main body, engagement of said door with said movable pin is removed.

5. An image forming apparatus according to claim 4, wherein said door is a jam removal door for removing said media jammed in said main body.

6. An image forming apparatus comprising:

a main body for forming an image on a media;

a first media tray, detachably mounted to said main body, for containing said media therein; and a second media tray being formed integrally with said first media tray, detachably mounted to said main body, and able to contain said media therein, wherein said second media tray is extendible from said first media tray, and said second media tray is switchable between a first state that said second media tray is housed in said main body and a second state that said second media tray is extended to outside of said main body and used for directly setting media from outside of said main body into said image forming apparatus;

wherein said second media tray is a manual insertion tray which is extendible in multiple steps;

wherein said main body includes a door being openable, and said first media tray includes a lock pin which prohibits said door from opening when said second media tray extends to outside of said main body, and permits said door to open when said second media tray is housed in said main body.

7. An image forming apparatus according to claim 6, wherein when said lock pin prohibits said door from opening, said lock pin prohibits said first media tray from separating from said main body, when said lock pin permits said door to open, said lock pin permits said first media tray to separate from said main body.

8. An image forming apparatus according to claim 7, wherein said door is a jam removal door for removing said media jammed in said main body.

9. An image forming apparatus according to claim 6, wherein said door is a jam removal door for removing said media jammed in said main body.

10. An image forming apparatus comprising:

a main body for forming an image on a media;

a first media tray, detachably mounted to said main body, for containing said media therein; and a second media tray being formed integrally with said first media tray, detachably mounted to said main body, and able to contain said media therein, wherein said second media tray is extendible from said first media tray, and said second media tray is switchable between a first state that said second media tray is housed in said main body and a second state that said second media tray is extended to outside of said main body and used for directly setting media from outside of said main body into said image forming apparatus;

wherein said second media tray is a manual insertion tray which is extendible in multiple steps;

wherein said main body includes a door being openable, said first media tray includes a movable pin, when said second media tray is extended to outside of said main body, said movable pin engaging with and stopping said door at a position where said door is closed, when said second media tray is housed in said main body, engagement of said door with said movable pin is removed.

11. An image forming apparatus according to claim 10, wherein when said second media tray is extended to outside of said main body, said movable pin engages with said main body, and when said second media tray is housed in said main body, engagement of said movable pin with said main body is removed.

12. An image forming apparatus according to claim 11, wherein said door is a jam removal door for removing said media jammed in said main body.

13. An image forming apparatus according to claim 10, wherein said door is a jam removal door for removing said media jammed in said main body.

14. An image forming apparatus comprising:

a main body for forming an image on a media;

a first media tray, detachably mounted to said main body, for containing said media therein; and a second media tray being formed integrally with said first media tray, detachably mounted to said main body, and able to contain said media therein, wherein said second media tray is extendible from said first media tray, and said second media tray is switchable between a first state that said second media tray is housed in said main body and a second state that said second media tray is extended to outside of said main body, and wherein said main body includes a door being openable, and said first media tray includes a lock pin which prohibits said door from opening when said second media tray extends to outside of said main body, and permits said door to open when said second media tray is housed in said main body.

15. An image forming apparatus according to claim 14, wherein said door is a jam removal door for removing said media jammed in said main body.

16. An image forming apparatus comprising:

a main body for forming an image on a media;

a first media tray, detachably mounted to said main body, for containing said media therein; and a second media tray being formed integrally with said first media tray, detachably mounted to said main body, and able to contain said media therein, wherein said second media tray is extendible from said first media tray, and said second media tray is switchable between a first state that said second media tray is housed in said main body and a second state that said second media tray is extended to outside of said main body, and wherein said main body includes a door being openable, said first media tray includes a movable pin, when said second media tray is extended to outside of said main body, said movable pin engaging with and stopping said door at a position where said door is closed, when said second media tray is housed in said main body, engagement of said door with said movable pin is removed.

17. An image forming apparatus according to claim 16, wherein said door is a jam removal door for removing said media jammed in said main body.

* * * * *